US009796103B2

(12) United States Patent
Durst et al.

(10) Patent No.: US 9,796,103 B2
(45) Date of Patent: Oct. 24, 2017

(54) METHOD AND TOOL UNIT FOR SETTING A PUNCHING GAP

(71) Applicant: Groz-Beckert KG, Albstadt (DE)

(72) Inventors: Frank Durst, Albstadt (DE); Ernst Heinemann, Renquishausen (DE); Kuno Horn, Nusplingen (DE)

(73) Assignee: GROZ-BECKERT KG, Albstadt (DE)

( * ) Notice: Subject to any disclaimer, the term of this patent is extended or adjusted under 35 U.S.C. 154(b) by 78 days.

(21) Appl. No.: 14/432,823

(22) PCT Filed: Oct. 4, 2013

(86) PCT No.: PCT/EP2013/070729
§ 371 (c)(1),
(2) Date: Apr. 1, 2015

(87) PCT Pub. No.: WO2014/053643
PCT Pub. Date: Apr. 10, 2014

(65) Prior Publication Data

US 2015/0298337 A1 Oct. 22, 2015

(30) Foreign Application Priority Data

Oct. 4, 2012 (DE) ..... 10 2012 109 434

(51) Int. Cl.
*B26D 1/00* (2006.01)
*B26D 5/08* (2006.01)
(Continued)

(52) U.S. Cl.
CPC ..... *B26D 7/0006* (2013.01); *B21D 28/04* (2013.01); *B26D 7/2628* (2013.01); *B26F 1/40* (2013.01); *B26F 2001/4463* (2013.01)

(58) Field of Classification Search
CPC .... B21D 28/04; B26D 7/0006; B26D 7/2628; B26F 1/40; B26F 2001/4463
(Continued)

(56) References Cited

U.S. PATENT DOCUMENTS 3,913,438 A * 10/1975 Walters ..... B21D 5/029 100/291
4,104,941 A * 8/1978 Krueger ..... B21D 28/26 83/133
(Continued)

FOREIGN PATENT DOCUMENTS

CN 1100976 A 4/1995
CN 2406789 Y 11/2000
(Continued)

OTHER PUBLICATIONS

International Search Report for corresponding PCT application No. PCT/EP2013/070729, dated Jan. 9, 2014, 4 pages.
(Continued)

*Primary Examiner* — Ghassem Alie
*Assistant Examiner* — Bharat C Patel
(74) *Attorney, Agent, or Firm* — Fitch, Even, Tabin & Flannery LLP

(57) ABSTRACT

A tool unit (II) includes an ability to change the width (B) of a punching gap between a first tool (12) and a second tool (13). A plurality of second tools (13) jointly form a die tool with a circumferential die cutting edge in which the first tool (12) can engage with a cutting edge (22). Between the cutting edge (22) of the first tool and the respective cutting edge (21) of a second tool (12) a punching gap (23) is formed with a width (B) measured between the cutting edges (21, 22) across the working direction (A). Via lamping means (33), the deformation force acting on a second tool (13) can act transversely to the working direction (A),
(Continued)

whereby the position of the affected cutting edge (21) and, with it, the width (B) of the punching gap (23), can be changed and set.

14 Claims, 5 Drawing Sheets

(51) Int. Cl.

| | |
|---|---|
| ***B26D 7/00*** | (2006.01) |
| ***B21D 28/04*** | (2006.01) |
| ***B26D 7/26*** | (2006.01) |
| *B26F 1/40* | (2006.01) |
| *B26F 1/44* | (2006.01) |

(58) Field of Classification Search
USPC ..... 83/640, 684–691, 699.41, 699.31, 133; 72/448, 456, 355.2
See application file for complete search history.

(56) References Cited

U.S. PATENT DOCUMENTS

| | | | | |
|---|---|---|---|---|
| 4,462,291 | A * | 7/1984 | Schulz | B26D 5/14 100/291 |
| 4,544,820 | A * | 10/1985 | Johnson | B23H 9/12 219/69.15 |
| 5,144,709 | A * | 9/1992 | Rooney | B21D 35/00 257/708 |
| 5,535,655 | A * | 7/1996 | Kammann | B26D 7/26 83/559 |
| 5,791,185 | A * | 8/1998 | Bodnar | B21D 28/36 72/190 |
| 6,042,280 | A | 3/2000 | Yamaguchi | |
| 6,546,833 | B1 * | 4/2003 | Gifford | B26D 7/015 83/34 |
| 6,575,069 | B1 * | 6/2003 | Harwarth | B26D 7/2628 83/583 |
| 6,721,060 | B1 | 4/2004 | Kawamura | |
| 6,799,498 | B2 * | 10/2004 | Spiel | B26D 7/2628 83/687 |
| 6,871,571 | B2 * | 3/2005 | Raney | B26D 5/32 269/21 |
| 6,883,410 | B2 * | 4/2005 | Kurita | B21D 35/00 83/220 |
| 7,121,178 | B2 * | 10/2006 | Halamoda | B26D 7/1863 83/164 |
| 7,578,223 | B2 * | 8/2009 | Bliss | B21D 22/02 72/446 |
| 7,640,836 | B1 * | 1/2010 | Raney | B26D 5/32 269/21 |
| 7,770,430 | B2 * | 8/2010 | Miceli | B21D 37/02 100/918 |
| 8,827,130 | B2 * | 9/2014 | Inoue | B21D 28/16 225/1 |
| 9,533,426 | B2 * | 1/2017 | Horn | B26D 7/0006 |
| 2003/0106400 | A1 * | 6/2003 | Lyons | B21D 28/14 83/13 |
| 2008/0110231 | A1 * | 5/2008 | Iwashita | B21D 28/14 72/456 |
| 2012/0227555 | A1 * | 9/2012 | Kim | B26F 1/40 83/55 |
| 2013/0019732 | A1 * | 1/2013 | Yotsumoto | B26F 1/40 83/331 |
| 2013/0074665 | A1 * | 3/2013 | Shijo | B23D 15/002 83/13 |
| 2013/0074666 | A1 * | 3/2013 | Kawada | B23D 33/00 83/23 |
| 2015/0028547 | A1 * | 1/2015 | Haglund | B26F 1/44 277/312 |

FOREIGN PATENT DOCUMENTS

| | | | |
|---|---|---|---|
| CN | 1129512 | C | 12/2003 |
| CN | 201220254 | Y | 4/2009 |
| DE | 544605 | C | 2/1932 |
| DE | 3012486 | C2 | 4/1985 |
| DE | 19933497 | A1 | 1/2001 |
| GB | 2347104 | A | 8/2000 |
| JP | S5861929 | A | 4/1983 |
| JP | S59156727 | U | 10/1984 |
| JP | 2003504224 | A | 2/2003 |
| JP | 2006224243 | A | 8/2006 |

OTHER PUBLICATIONS

Office action and search report in corresponding Chinese application No. 201380063247.1, dated May 11, 2016, 23 pages.
Office action in corresponding German application No. 10 2012 109 434.9, dated Jun. 25, 2013, 7 pages.
Notice of Reasons for Rejection in corresponding Japanese Application No. 2015-535033, dated Jul. 4, 2017, 8 pages.

* cited by examiner

METHOD AND TOOL UNIT FOR SETTING A PUNCHING GAP

CROSS REFERENCE TO RELATED APPLICATIONS

This patent application is the national phase of PCT/EP2013/070729 filed Oct. 4, 2013, which claims the benefit of German Patent Application No. 10 2012 109 434.9 filed Oct. 4, 2012.

TECHNICAL FIELD

The invention relates to method and a tool unit for setting a punching gap of a punching or cutting machine.

BACKGROUND

The tool unit comprises a first tool and a second tool. During cutting or punching operations, the two tools are moved relative to each other. A cutting edge on the first tool and a cutting edge on the second tool work together in order to cut or punch a workpiece, for example a foil. It is also possible for there to be a multiple first and/or second tools.

Such cutting or punching machines have been known per se. For example, publication DE 30 12 486 C2 describes a punching machine that comprises web-shaped or sheet-shaped material for punching flat objects. In this case, the relative movement between the first tool and the second tool is generated by a wedge drive. In accordance with the example, a transverse movement of a wedge body transversely to the working direction of the punching tool results in the movement of a lower tool toward or away from the upper tool in working direction. Consequently, the punching stroke is performed by the lower tool via a transverse movement of a wedge.

Publication DE 544 605 describes a device for setting the height of a lower knife in a cutting machine. Viewed in working direction, the position of the cutting knife can be adjusted via one or more spindles, as well as via a wedge adjustment.

During the first startup of the punching or cutting machine, the gap between the first and the second tool must be set. In addition, during operation of the punching or cutting machines, the two tools come into contact with the material to be punched during each working stroke and are thus subject to wear. This results in the fact that a punching or cutting gap between the first tool and the second tool will enlarge. Consequently, during the first startup and during operation, the setting of the punching or cutting gap is necessary. An exact gap width is of great importance in particular in the case of precision tools. If the gap is or becomes too large, the quality of the cut or punched edge on the workpiece becomes inferior, e.g., a burr may form on the workpiece. Such a burr formation is undesirable. For example, such a burr in punched foils for rechargeable batteries may result in short circuits in adjacent foils. Therefore, the exceeding of a maximum value of the gap width must be prevented.

SUMMARY

Consequently, the object of the invention may be viewed to be a method and a tool unit for a cutting or punching machine, wherein the punching or cutting gap can be set in very simple manner.

In accordance with the invention, means for setting a deforming force are used to at least partially plastically or elastically deform at least the second tool and, as a result of this, set the width of the punching or cutting gap. In particular, an enlargement of the punching gap due to wear is at least partially compensated for by increasing the deforming force. The deforming force is oriented, in particular in a transverse direction, transversely to the direction of movement of the first or second tool. Additionally, it is also possible to apply a deforming force to the first tool by associate means in order to set the punching or cutting gap. The embodiments that will be explained hereinafter in view of the second tool can also be used for the first tool.

The deformation may be plastic or elastic. In particular when the gap width is set in the course of the first startup, the affected tool can also be plastically deformed. Such an elastic or plastic deformation may be produced in a very simple manner by clamping means that mount the second tool to a holding device. As a result of the invention, complex machining of the second tool—in particular its cutting or punching edge—is unnecessary for setting the punching or cutting gap to the desired size. An extremely precise setting of the gap can occur.

For example, the second tool may comprise at least one supporting part whose rear surface supports itself against the associate supporting surface of the holding device for the second tool. Preferably, the rear surface extends in an inclined manner at the same angle of inclination relative to the working direction and thus parallel to the supporting surface. Preferably, the supporting surface and the rear surface are configured so as to be without offset and flat without edges. They, as it were, form a force transmitting means that, in the transverse direction transversely to the working direction, can transmit a deforming force to the second tool in the direction toward the punching or cutting gap. With the use of the at least one pulling and/or pushing means that counteracts the tool movement away from the supporting surface, the deformation of the second tool is accomplished.

Preferably, at least one supporting surface of a supporting part may support itself against the second tool. The supporting part supports itself, by way of its rear surface, on its side opposite the contact surface against a supporting surface. In particular, the supporting surface and/or the rear surface are oriented inclined at an angle of inclination so as to be inclined relative to the working direction. Preferably, at least one pulling and/or pushing means is provided that applies a holding force to the second tool and counteracts a shift in transverse direction transversely away from the supporting surface. By clamping the at least one supporting part with a clamping force in working direction, said supporting part is clamped between the supporting surface and the second tool and exerts a deforming force on the second tool in a direction transverse to the punching or cutting gap. Due to the holding force of the pulling and/or pushing means counteracting the deforming force, the second tool is not shifted relative to the punching or cutting gap but is itself deformed and thus also deforms the cutting edge. As a result, the width of the punching or cutting gap is changed. Consequently, a very simple and precise option is provided for varying the punching or cutting gap by an elastic or plastic deformation of the second tool.

For the deformation of the second tool and its cutting edge, the holding force and the deforming force preferably act in the direction of extension of the cutting edge along the punching or cutting gap at spaced-apart locations on the second tool. In doing so, a bending deformation of the second tool and of the cutting edge may occur.

The pushing and/or pulling means may be an armature or screws or similar means. Alternatively or additionally, the pushing means may also be a stop means, which is in contact with the side of the second tool facing the punching or cutting gap. In particular, the stop means may be arranged adjacent the punching or cutting gap, for example in extension of the punching gap or next to it.

In one embodiment, the deforming force may also be generated by a force generating unit that comprises, for example, electrical, mechanical, hydraulic or pneumatic means and can preferably be electrically activated. For example, the force generating unit may comprise a motor spindle unit.

In a preferred embodiment, several second tools may be provided that, together, form a die tool. In doing so, the cutting edges of two adjacent second tools may adjoin each other and, in particular, form an almost closed die cutting edge. The second tools may be arranged at a minimal distance, in particular, of a few micrometers next to each other, or they may touch each other without acting on each other at a force great enough for a deformation. The first tool can engage in the space between the second tools, said space being enclosed by the die cutting edge.

The deforming force may be varied, for example, in that the height of the second tool is reduced at least incrementally. Preferably, the height of the at least one supporting part is changed, and the height of the second tool remains unchanged. As a result of this, the dimensions of the supporting part at the point of the smallest dimension between the supporting surface and the first tool can be increased in transverse direction. As a result of this, the deforming force increases, whereby the width of the punching or cutting gap is changed and, in particular, reduced.

Preferably, the second tool consists of steel, ceramic, hard metal or another suitable material depending on the material to be punched. At least one section having the cutting edge of the second tool is made of one of the said materials. The second tool or at least the section having the cutting edge may have a hardness that is greater than the hardness of the at least one supporting part of the second tool.

In a preferred exemplary embodiment, the at least one supporting part is configured so as to be a separate component. Alternatively, it may also be immovably connected to the second tool, for example by means of a material-bonded connection. The second tool and the at least one supporting part may also be made in one piece of a material without seams and joints.

For example, the region or surface section provided for changing the height may exhibit less hardness on the underside of the second tool than the tool part having the cutting edge, so that a height reduction, for example by grinding, may take place in a less hard region of the second tool. If only the height of the supporting part is changed, the entire second tool may be made of a material that is sufficiently hard for punching and cutting, respectively, and need not be readily machinable by grinding or another material removing process.

Advantageous embodiments of the inventive method and the inventive device can be inferred from the dependent patent claims and the description. The description is restricted to essential features of the invention. Hereinafter, preferred embodiments of the method and of the device will be explained in detail with reference to the appended drawings. They show in

DETAILED DESCRIPTION

Figure 1:
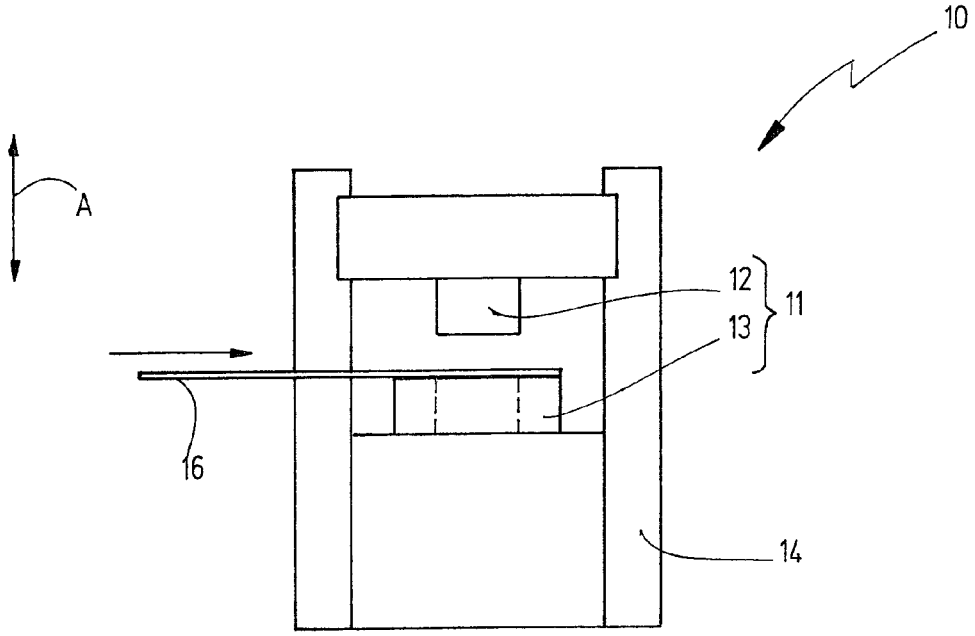
FIG. 1 a schematic representation resembling a block diagram of a punching machine, FIG. 2 a schematic representation of a workpiece to be punched, in plan view, FIG. 3 a schematic view in working direction of a die tool comprising several second tools, FIGS. 4 and 5 perspective representations of an exemplary embodiment of a second tool, FIGS. 6 and 7 schematic representations of a second tool, with different deforming forces for setting the punching gap, FIG. 8 a schematic side elevation, partially in section, of an alternative exemplary embodiment of a second tool, and FIG. 9 a schematic representation resembling a block diagram, of the second tool as in FIGS. 3 to 7, with a force generating unit for generating the deforming force, in plan view.
Figure 2:
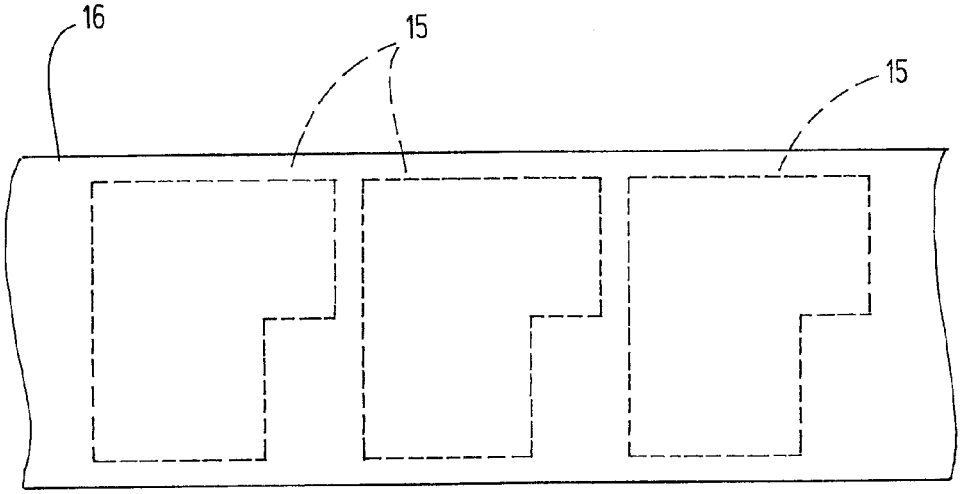

FIG. 1 shows a punching machine 10 in a highly schematized representation. The punching machine 10 comprises an inventive tool unit 11 with a first tool 12 and a second tool 13. Furthermore, said machine is adapted to perform the method in accordance with the invention. Instead of in the punching machine 10, the invention may also be used in cutting machines or other stamping machines.

The two tools 12, 13 can be moved relative to each other in a working direction A. In the exemplary embodiment, the first tool 12 is support so that it can be movably guided in the working direction A on a machine frame 14 and can be moved by means of a not specifically illustrated drive. Alternatively, the second tool 13 or both tools 12, 13 may be movably arranged. In accordance with the example, the first tool 12 represents an upper tool of the punching machine 10. In the exemplary embodiment, the second tool 13 is immovably arranged relative to the machine frame 14 and, in accordance with the example, configured as the lower tool. By a stroke the first tool 12 relative to the second tool 13 a form 15 is punched out of workpiece 16. In accordance with the example, the workpiece 16 is a plate or a foil and may be fed in the form of a web to the punching machine 10. In particular, the punching machine 10 can be used for punching foils, for example lithium foils for rechargeable batteries, in the desired form 15 out of the workpiece 16.

In the exemplary embodiment described here, the tool unit 11 comprises several second tools 13 that, together, form a die tool 20. The number and arrangement of the second tools 13 depends on the form 15 that is to be punched out of the workpiece 16. Each second tool 13 has a cutting edge 21, in which case the cutting edges 21 of adjacent second tools 13 adjoin each other and form a continuous die cutting edge. In order to perform a simple cut in the workpiece 16, also a single second tool 13 may be sufficient. Correspondingly, several first tools 12 may also be provided.

A punching gap 23 is formed between the cutting edge 21 of each second tool 13 and a cutting edge 22 of the first tool 12. In order to avoid losses of quality and, for example the formation of burrs on the workpiece 16 or the punched form 15, the punching gap 23 must not exceed a prespecified maximum width. At the time of the first startup of the punching machine, the punching gap 23 must be set precisely. In the course of the operation of the punching machine 10, signs of wear also occur on the at least one first tool 12 and/or on the at least one second tool 13, as a result of which the punching gap 23 can enlarge. In accordance with the invention, there is provided a means for setting the punching gap 23 with which the at least one of the two tools 13 can be plastically or elastically deformed and thereby a reduction, in particular a reduction of the width B of the affected punching gap 13 can be achieved. In the described exemplary embodiment, all the second tools 13 can be deformed, however, this need not absolutely be the case. In some applications it may be sufficient to apply a respectively associate deforming force FV to only a part of the second tools 13.

Figure 3:
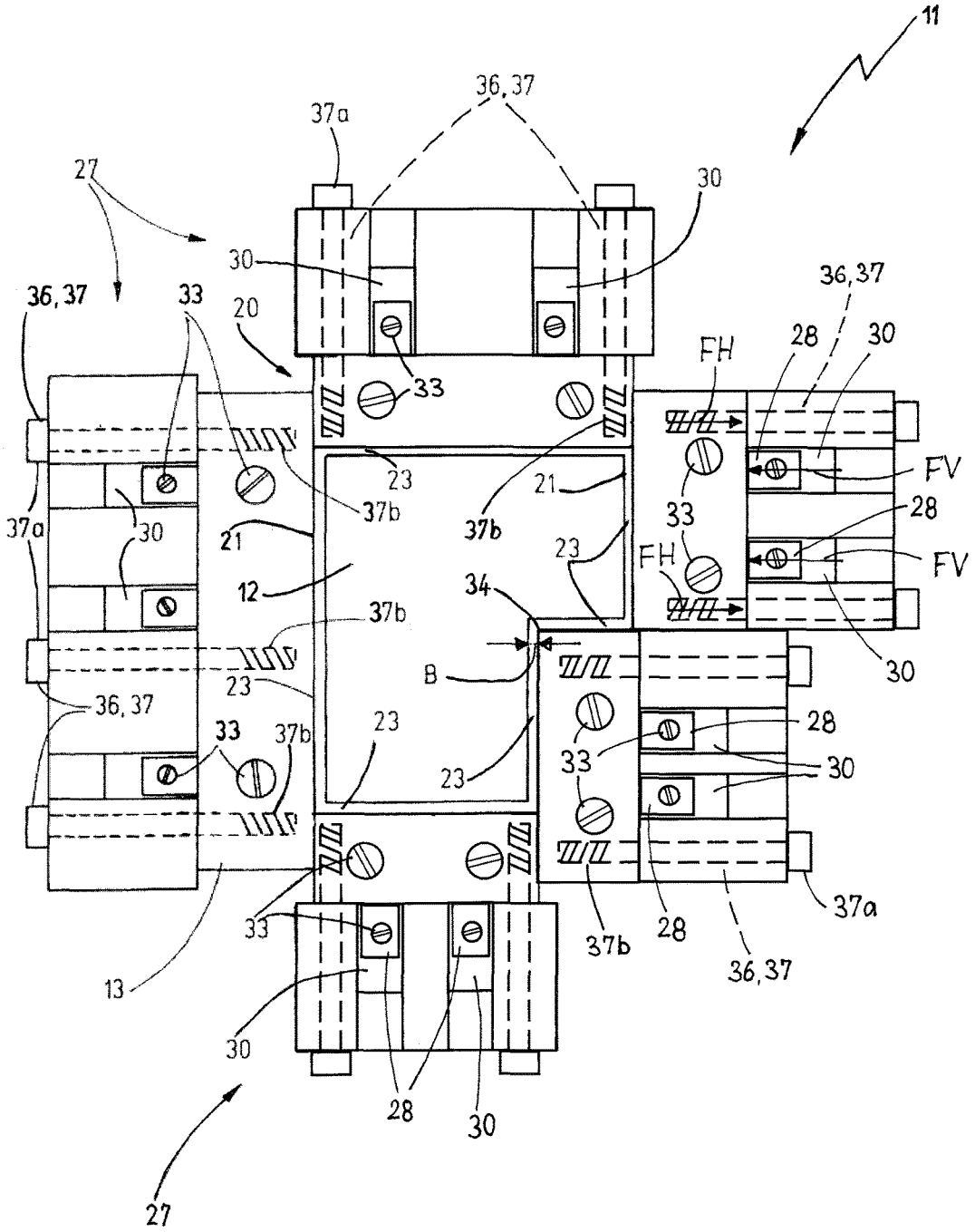
Figure 4:
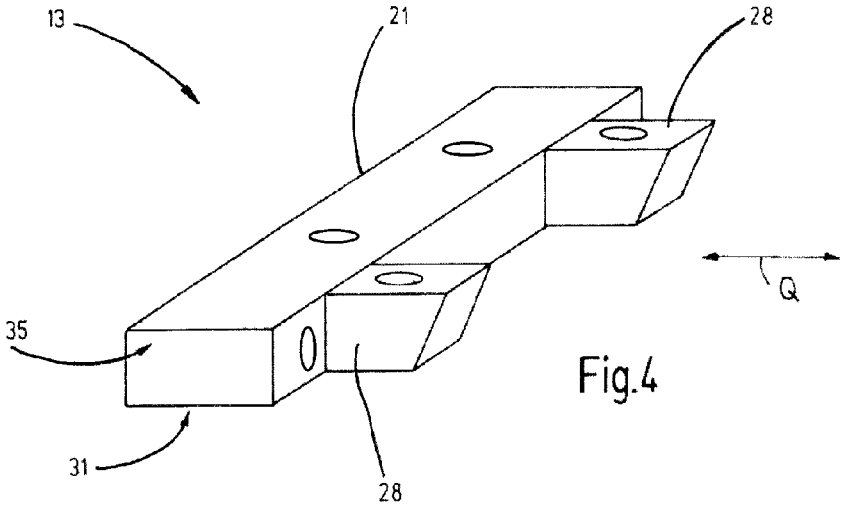
Figure 5:
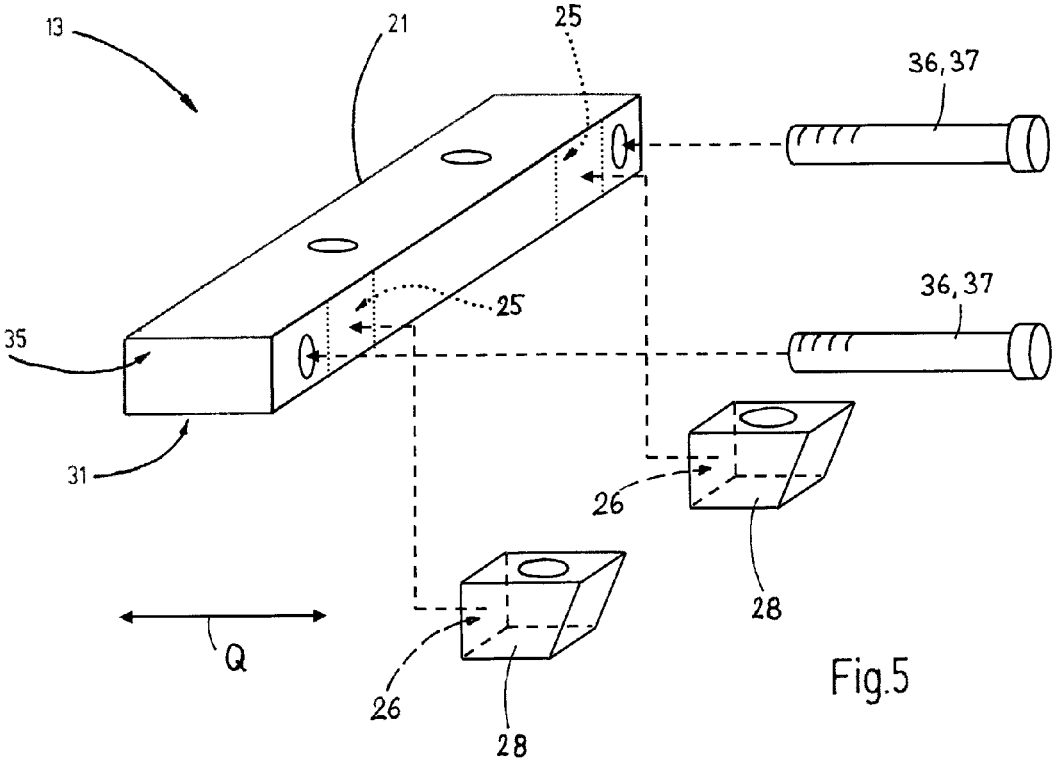
Figure 6:
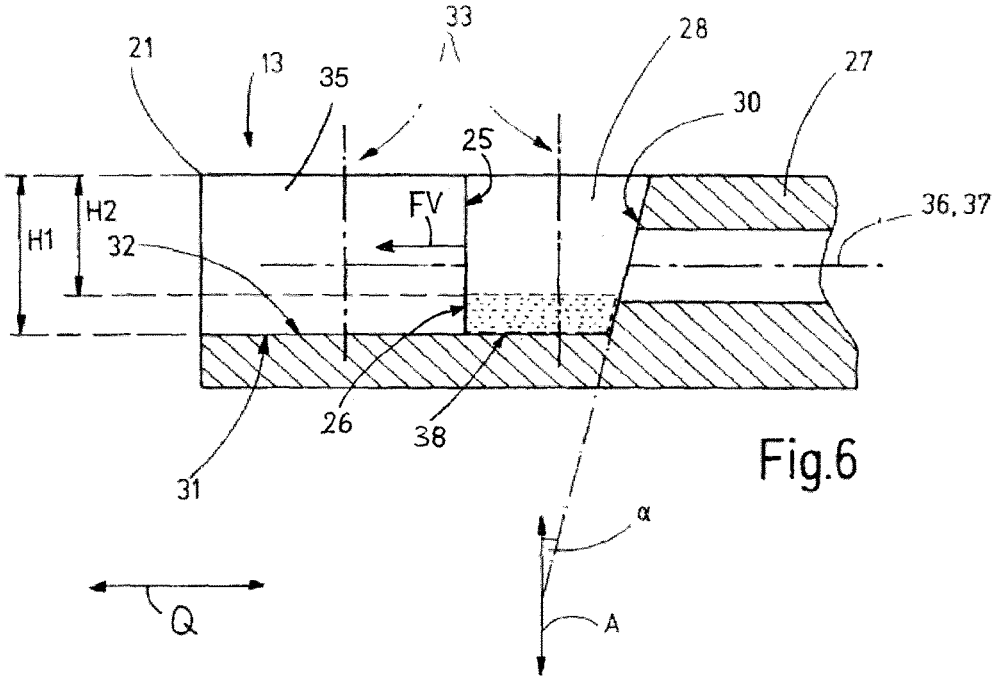
Figure 7:
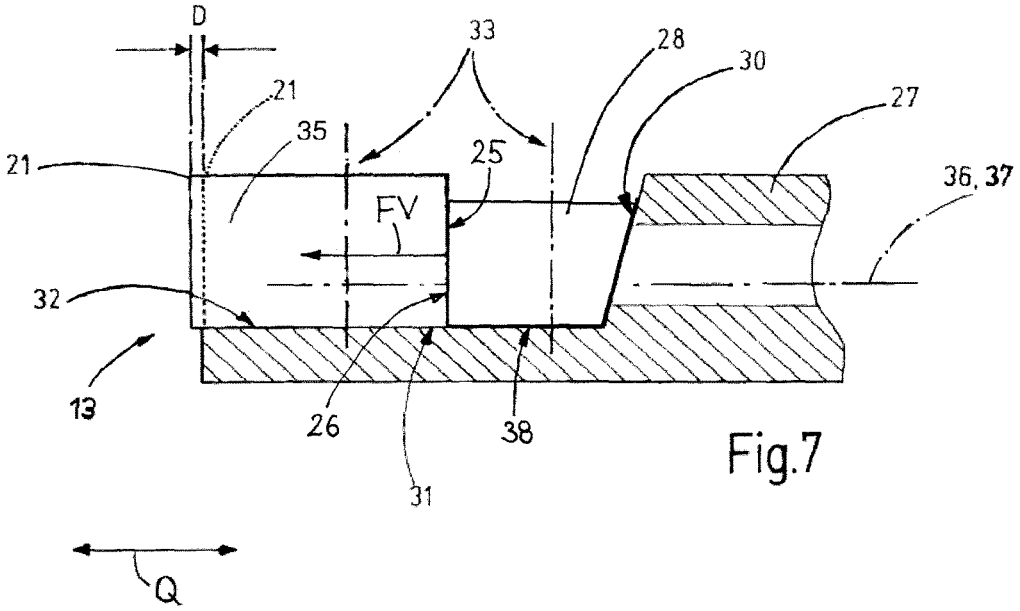

The second tools 13 are releasably fastened to a holding device 27 (FIGS. 3, 6 and 7). Each second tool 13 is associated with at least one supporting part 28. In accordance with the example, each second tool 13 is allocated two or three supporting parts 28. In the exemplary embodiment according to FIGS. 3 to 7, the supporting parts 28 are located on the side facing away from the punching gap 23 or the cutting edge 21 and extend, transversely to the working direction A, in transverse direction Q away from the cutting edge 21 or the second tool 13. The orientation of the second transverse direction Q relates to the respectively second tool 13 and extend transversely to the affected cutting edge 21. Each supporting part 28 has a contact surface 28 facing the second tool 13, said contact surface contacting a counter contact surface 25 of the second tool. On the opposite side, each supporting part 28 has a second rear surface 29 facing away from the second tool 13, said rear surface being in contact with an associate supporting surface 30 of the holding device 27. The rear surface 29 and the associate supporting surface 30 extend parallel to each other and are configured as to be flat and without offsets and edges. The supporting surface 30, as well as the rear surface 29, extend at an angle of inclination a inclined relative to the working direction A. The supporting surface 30, as well as the rear surface 29 are also inclined relative to the transverse direction Q.

The first underside 31 of the second tool 13, said side facing away from the first tool 12, is supported by a supporting surface 32 of the holding device 27. The underside 38 of each supporting part 28 is supported by the bearing surface 32 of the holding device 27. The undersides 31, 38 and the bearing surface 32 are preferably configured to be flat, without offsets and edges. With the use of clamping means 33, for example screw connections, each second tool 13 and each supporting part 28 are firmly clamped in place on the holding device 27 in working direction A. In accordance with the example, the underside 31 of the second tool 13 and the undersides 38 of the supporting parts 28 are clamped against the bearing surface 32 by means of an associate clamping means 33. Preferably, the clamping means 33 are configured in such a manner that they absorb no or only a minimal force in transverse direction Q transversely to the working direction A.

Figure 9:
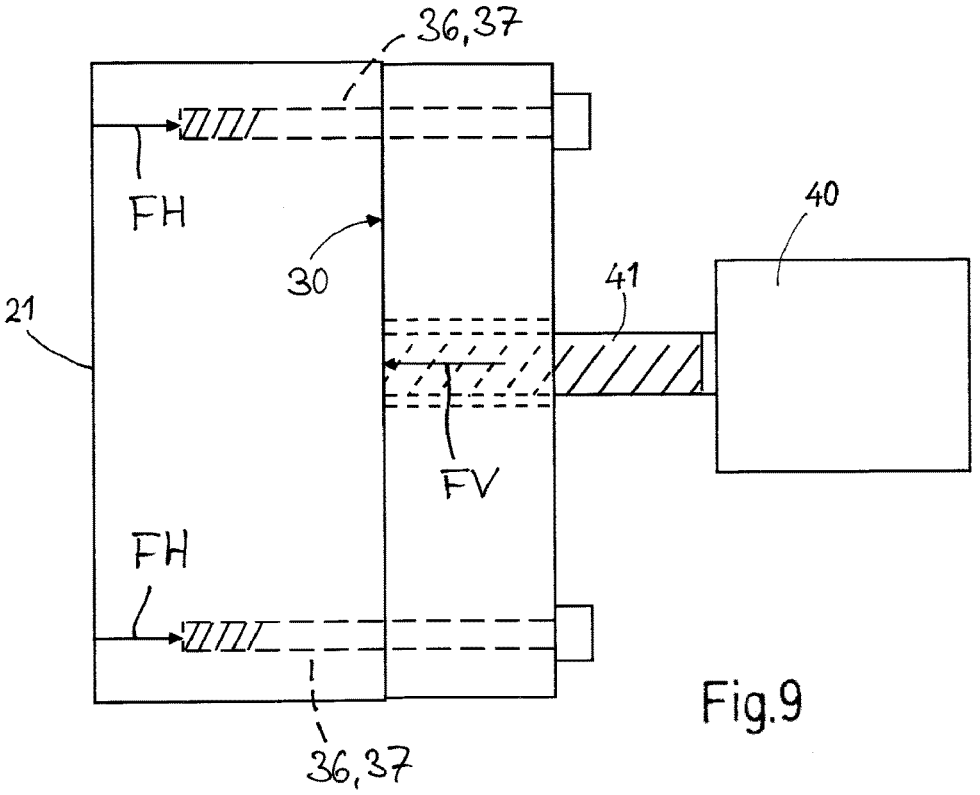

At least one pulling and/or pushing means 36 is associated with the second tool 13 that is to be deformed, said pulling and/or pushing means being adapted to counteract a movement of the second tool 13 away from the supporting surface 30 when the supporting parts 28 and the supporting surface 30 generate a deforming force FV. FIGS. 3, 5 and 9 schematically illustrate pulling and/or pushing means 36 that are embodied as screws 37. These extend through the holding device 27 and can be shifted relative to the holding device 27 in their first direction of extension. A head 37*a* of the screws 37 is supported by the holding device 27, in which case their opposite end is fastened to the associate second tool 13 and, in the exemplary embodiment, screwed together via a screw thread 37*b*. The pulling and/or pushing means 36 and the screws 37, respectively, are arranged so as to be offset in the extension direction of the cutting edge 21 of the second tool 13 relative to the supporting parts 38 (FIGS. 3, 5 and 9), so that one of the pulling and/or pushing means 36 will not extend through the supporting parts 28. Preferably, the supporting parts 28 associated with one of the second tools 13 are arranged, in the extension direction of the cutting edge 21, between two outer pulling and/or pushing means 36 and the screws 37, respectively.

One of the second tools 13 in accordance with FIG. 3 has two cutting edges 21 that form a corner 34. Different from the illustration of FIG. 3, each cutting edge 21 can be associated on the opposite side of the second tool 13 with a supporting part 28 being supported by the supporting surface 30 of the holding device 27. This second tool 13 can be adjusted in two directions with a deforming force FV for setting the width B of the affected punching gap 23. For the sake of clarity, the second tool 13 having the corner 34 is shown only with the means 28, 30, 36, 37 used for setting the punching gap 23 on the longer cutting edge 21.

Due to the angle of inclination a of the supporting surface 30, it is possible to generate a deforming force FV on the second tool 13 by clamping the supporting parts 28 associated with the affected second tool 13 in place with the clamping means 33. During the clamping operation, the rear surface 29 comes into contact with the supporting surface 30 already before the underside 38 of the supporting part 28 on the supporting surface 32 has reached its end position. Due to the pulling and/or pushing means 36 and the screws 37, respectively, the second tool 13 can however not be moved away from the inclined supporting surface 30 during the clamping operation. The pulling and or pushing means 36 and the screws 37, respectively, exert a holding force FH on the second tool 13. In the direction of extension of the cutting edge 21, offset relative to these holding forces FH, each supporting part 28 produces a deforming force FV. The forces FH, FV are oriented in transverse direction Q and counteract each other. Thus, the deforming force FV is anti-parallel to the holding force FH. In doing so, the deforming force FV is great enough for deforming the second tool 13 in transverse direction Q. Due to this deformation, the position of the cutting edge 21 of the respective second tool 13 can be changed relative to the cutting edge 22 of the associate first tool 12, and thus the width of the punching gap 23 can be set. Therefore, it is possible—if necessary—to set the gap width B of the punching gap 23 at the time of the assembly, the first startup or during the running operation. For example, the gap width B can be reduced if it has increased due to wear. This shifting of the position of the cutting edge 21 to reduce the gap width B of the punching gap 23 by an increased deforming force FV of the associate supporting parts 28 is schematically shown by FIGS. 6 and 7.

The position changes of the cutting edge 21 of the second tool 13 via its deformation are small and are within the range of 1 to 2 micrometers. However, this shift of the cutting edge 21 is sufficient for the subsequent adjustments of the punching gap 23—that usually has a width of 1 to 3 or up to 4 micrometers in order to obtain a qualitatively perfect and, in particular, virtually burr-free punching edge on the form 15.

Instead of a screw 37 or another pulling means, the second tool 13 can be associated with a stop means, for example a stop surface or another suitable pushing means, on its side facing away from the supporting surface 30, so that the second tool 13 is deformed by means of the stop surface or the pushing means and the supporting parts 28.

In order to change the deforming force FV of a second tool 13 and/or the position of its cutting edge 21, the underside 38 of the supporting part 28 is machined in this exemplary embodiment. As a result of this, the height of the supporting part 28 can be reduced in working direction A from a first height H1 to a second height H2 (FIGS. 6 and 7). Preferably, in so doing, it is only the underside 38 of the at least one associate supporting part 28 that is being machined and not the underside 31 of the second tool 13, so that only the height of the at least one supporting part 28 is changed. For example, it is possible to remove a layer from the underside 38 of the supporting part 28, as schematically illustrated by dots in FIG. 6.

Inasmuch as the supporting surface 30 is inclined its distance from the first tool 12—viewed along the working direction A—decreases toward the bearing surface 32. The supporting parts 28 are clamped in place by means of the clamping means 33 until the underside 38 reaches its end position and is in contact at least in part with the bearing surface 32. As a result of this, the effective dimension of the at least one supporting part 28 increases, as it were, in transverse direction Q, i.e., viewed in the direction of the width of the punching gap 23. The rear surface 29 of the supporting parts 28 is supported by the supporting surface 30, and the opposing contact surface 26 is supported by the contact surface 26. As a result of this, they apply a greater deforming force FV on the second tool 13, compared with the deforming force FV prior to the reduction of the height of the supporting parts 28. The pulling and/or pushing means 36 and the screws 27, respectively, apply a holding force FH to the second tool 13 in order to counteract a shifting due to the forces of the supporting parts 28. As a result of this, the position of the cutting edge 21 relative to the cutting edge 22 of the first tool 12 can be changed, and the gap width B of the punching gap 23 can be reduced by a difference value D (FIG. 7).

It is pointed out that the illustration of FIGS. 6 and 7 is not true to scale and merely is a schematic diagram illustrating the basic principle of the mode of operation.

In modification of the described exemplary embodiment, the height of the second tool 13 and the associate supporting parts 28 may be changed, for example whenever the second tool 13 and the supporting parts are connected to each other. However, as a rule, this is not necessary, and—because of the hardness of the second tool 13—preferably only the at least one supporting part 28 is machined on its underside 38 as described hereinabove.

The second tool 13, and preferably all the second tools 13 consist of steel, ceramic, hard metal or other "suitable materials. It is also possible to specially harden or make only one of the regions of the second tool 13 having the cutting edge of hard metal. In accordance with the example, the hardness of the second tool 13 or at least the region having the cutting edge is greater than the hardness of the associate supporting parts 28.

In one embodiment, the region comprising the underside 31 of the second tool 13 may have a lesser hardness than the region that has the cutting edge 21. As a result of this, the underside 31 of the second tool 13 can be better machined for reducing the height.

Figure 8:
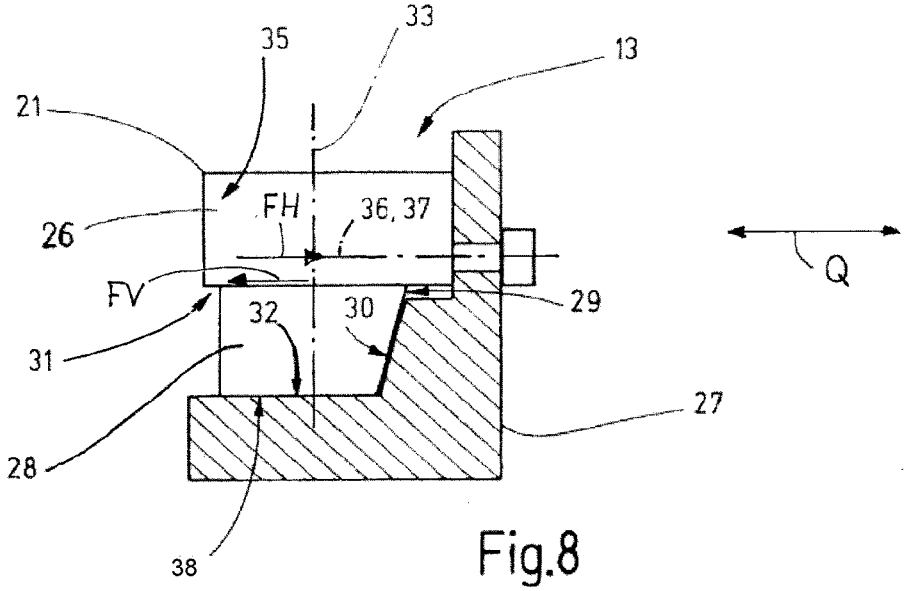

FIG. 8 shows a modified embodiment of a second tool. In this case, the supporting part 28 is not provided—as previously described—on the side opposite the cutting edge 21 but on the underside 31 of the second tool 13. The rear surface 29 provided on the supporting part 28—as previously described—is associated with a supporting surface 30. For changing the deforming force FV, also in this embodiment it is not the underside 31 that is machined but the underside 38 adjoining the rear side 29 of the supporting parts 28. When the supporting parts are clamped against the bearing surface 32, the supporting parts 28 are pushed away from the supporting surface 30 and, in doing so, can apply a deforming force FV to the second tool 13. In this exemplary embodiment, the supporting parts 28 and the second tool 13 are preferably immovably connected to each other, for example by a material-bonded connection, or without seams and joints in one piece. Other than that, the function and the design correspond to the previously described exemplary embodiments so that reference is made to the description hereinabove.

FIG. 9 shows another modified exemplary embodiment. In this modification, the supporting parts 28 are omitted. The side of the tool 13 facing away from the cutting edge 21 is supported by the supporting surface 30 of the holding device 27. The supporting surface 30 is not inclined with respect to the working direction A. The second tool 13 is connected to a force generating unit 40 that may comprise, e.g., an electric motor or hydraulic or pneumatic means for generating the force. In doing so, the deforming force FV can be generated—instead of by the at least one supporting part 28—by a spindle 41 driven by an electric motor and transmitted to the second tool 13. As in the modifications described hereinabove, a holding force FH is applied to the second tool 13 via the pulling and/or pushing means 36, said holding force being directed against the deforming force FV. Therefore, it is possible, via the force generating unit 40, to set the width B of the punching gap 23 as in the other embodiments.

In modification of the exemplary embodiment illustrated by FIG. 9, it is also possible for a manual setting means to be provided instead of the force generating means 40. For example, the spindle 41 can be replaced by a screw pushing against the second tool 13 or by another suitable pushing means for the manual adjustment of the deforming force FV.

With the use of the force generating unit 40, it is also possible to control the width B of the punching gap of the associate second tool 13. For example, the width B can be measured, in particular, by an optical measuring device, and compared with a set value in the control unit. If there are deviations, the control unit activates the force generating unit 40 to increase or decrease the deforming force FV.

In principle, it is possible in the exemplary embodiments described hereinabove to configure the supporting parts 28 and the second tool 13 as separate components or to immovably connect them to each other, for example by a material-bonded connection, or without seams and joints in one piece. The features of the diverse exemplary embodiments of the second tool 13 can also be combined with each other. Supporting parts 28 may be provided on the underside 31, as well as on the side of the second tool 13 opposite the cutting edge 21 (FIGS. 3 to 7 and 8).

In all the embodiments it is advantageous to set the deforming force FV at various locations of a second tool 13 with different strengths. This is done, for example, for adapting the width B of the punching gap 23 to an uneven line of the associate edge of the first tool 12. To do so, the second tool 13 is associated, for example, with several supporting parts 28 and several pulling and/or pushing means 36, by means of which a respectively desired value for a local deforming force FV can be set.

The invention relates to a tool unit 11 and a method for changing the width B of a punching gap 23 between a first tool 12 and a second tool 13 of the tool unit 11. Preferably, there are present a plurality of second tools 13 which jointly form a die tool 20 with a circumferential die cutting edge, in which the first tool 12 can engage with its cutting edge 22. Between the cutting edge 22 of the first tool 12 and the respective cutting edge 21 of a second tool 13, a punching gap 23 is formed with a width B which is measured between the cutting edges 21, 22 across the working direction A in transverse direction Q. The first tool 12 and the second tool 13 are moved relative to one another in the working direction A. Via clamping means 33, the deforming force FH acting on a second tool 13 can act transversely to the working direction A, whereby the position of the affected cutting edge 21 and, with it, the width B of the punching gap 23 can be changed and set.

LIST OF REFERENCE SIGNS

10 Punching machine
11 Tool unit
12 First tool
13 Second tool
14 Machine frame
15 Form
16 Workpiece
20 Die tool
21 Cutting edge of the second tool
22 Cutting edge of the first tool
23 Punching gap
25 Counter contact surface
26 Contact surface
27 Holding device
28 Supporting part
29 Rear surface
30 Supporting surface
31 Underside of the second tool
32 Bearing surface
33 Clamping means
34 Corner
35 Tool part
36 Pulling and/or pushing means
37 Screw
37*a* Head
37*b* Screw thread
38 Underside of the supporting surface
40 Force generating unit
41 Spindle
α Angle of inclination
A Working direction
B Width of the punching gap
D Difference value
FH Holding force
FV Deforming force
H1 First height value
H2 Second height value

The invention claimed is:

1. Method for setting a punching or cutting gap (23) on a tool unit (11) of a punching or cutting machine (10), wherein the tool unit (11) comprises one first tool (12) and at least two second tools (13), the method comprising:

moving the one first tool (12) and the at least two second tools (13) relative to each other in a working direction (A) to define a punching or cutting gap (23) having a width (B), wherein the punching or cutting gap (23) exists between the first tool (12) and the at least two second tools (13) transversely to working direction (A), the at least two second tools (13) supported via at least one supporting part (28) in a direction transverse to the working direction (A) on a side facing away from the punching or cutting gap (23), the at least one supporting part (28) supported by a rear surface (29) on a supporting surface (30) oriented at an angle of inclination (α) in an inclined manner with respect to the working direction (A), and setting the width (B) of the punching or cutting gap (23) in a transverse direction (Q) transverse to the working direction (A) by deforming the at least two second tools (13) with a manual or automated force generating mechanism driving the at least one supporting part (28) such that the supporting surface (30) oriented at the angle of inclination (α) forces the at least one supporting part (28) to apply a deforming force (FV) to the at least two second tools (13).

2. Method as in claim 1, further comprising applying the deforming force (FV) acting on the at least two second tools (13) in a transverse direction (Q), transversely to the working direction (A).

3. Method as in claim 2, further comprising generating the deforming force (FV) via a force generating unit (40).

4. Method as in claim 1, further comprising the at least one supporting part (28) having a height (H2) smaller than a height (H1) of the at least two second tools (13).

5. Method as in claim 1, further comprising the at least one supporting parts (28) acting on the at least one second tools (13) with the deforming force (FV) acting in transverse direction (Q).

6. Method as in claim 1, further comprising applying a holding force (FH) acting in transverse direction (Q) to the at least two second tools (13).

7. Method as in claim 1, further comprising directing a deforming force (FV) toward the punching or cutting gap (23), and directing a holding force (FH) in opposite direction away from the punching or cutting gap (23).

8. Method as in claim 1, further comprising a deforming force (FV) and a holding force (FH) acting on the at least two second tools (13) at spaced-apart points arranged in extension direction of a cutting edge (21) of the at least two second tools (13).

9. Method as in claim 1, further comprising, for setting the width (B) of the punching or cutting gap (23), reducing the height (H1) of the at least two second tools (13) at least in sections.

10. Tool unit (11) for a punching or cutting machine (10), the tool unit comprising:

a first tool (12) and at least two second tools (13), wherein the first tool (12) and the at least two second tools (13) can be moved for punching or cutting relative to each other in a first working direction (A), the first tool (12) and the at least two second tools (13) disposed to define a punching or cutting gap (23) having a width (B) and transverse to the working direction (A) between the first tool (12) and the at least two second tools (13), wherein the at least two second tools (13) are configured to be supported via at least one supporting part (28) in a direction transverse to the working direction (A) on a side facing away from the punching or cutting gap (23), the at least one supporting part (28) supported by a rear surface (29) on a supporting surface (30) oriented at an angle of inclination (α) in an inclined manner with respect to the working direction (A), means (28, 30, 36, 40) for generating a deforming force (FV) to deform the at least two second tools (13) by driving the at least one supporting part (28) such that the supporting surface (30) oriented at the angle of inclination (α) forces the at least one supporting part (28) to apply a deforming force (FV) to the at least two second tools (13) to apply a deforming force (FV) to the at least two second tools (13) for setting the punching gap (23) transverse to the working direction (A).

11. Tool unit as in claim 10, wherein the at least one supporting part (28) is configured to be supported with a contact surface on the at least two second tools (13) and with the rear surface (29) facing away from the punching or cutting gap (23) on the supporting surface (30) of a holding device (27) for the at least two second tools (13).

12. Tool unit as in claim 11, wherein the at least two second tools (13) are associated with at least one pulling and/or pushing means (36, 37) that acts against a movement of the at least two second tools (13) away from the supporting surface (30).

13. Tool unit as in claim 12, wherein the at least one supporting part (28) is configured to apply the deforming force (FV) for deformation of the at least two second tools (13) by acting toward the punching or cutting gap (23), and the pulling and/or pushing means (36) is configured to apply the holding force to act from the punching or cutting gap (23) away on the at least two second tools (13).

14. Tool unit as in claim 10, further comprising at least three second tools (13) jointly forming a die tool (20).

* * * * *